US006918148B2

(12) United States Patent
Auxila

(10) Patent No.: US 6,918,148 B2
(45) Date of Patent: Jul. 19, 2005

(54) ARM PILLOW FOR HOLDING A CHILD

(76) Inventor: Jeannie Auxila, 1167 S. Denning Dr., Winter Park, FL (US) 32789

( * ) Notice: Subject to any disclaimer, the term of this patent is extended or adjusted under 35 U.S.C. 154(b) by 0 days.

(21) Appl. No.: 10/649,514

(22) Filed: Aug. 26, 2003

(65) Prior Publication Data

US 2005/0044633 A1 Mar. 3, 2005

(51) Int. Cl.[7] ..... A47C 20/00
(52) U.S. Cl. ..... 5/655; 5/646; 2/16
(58) Field of Search ..... 5/646, 655; 2/16

(56) References Cited

U.S. PATENT DOCUMENTS 3,189,919 A * 6/1965 Chase ..... 2/16
4,120,052 A * 10/1978 Butler ..... 2/16
4,393,520 A * 7/1983 Koch ..... 2/16
5,109,557 A * 5/1992 Koy et al. ..... 5/655
5,224,637 A * 7/1993 Colombo ..... 224/159
5,440,769 A * 8/1995 Thomas ..... 5/655
5,781,935 A * 7/1998 Bassett et al. ..... 2/455
5,887,277 A * 3/1999 Lohman ..... 2/16
6,381,786 B1 * 5/2002 Cadden ..... 5/655

* cited by examiner

*Primary Examiner*—Michael Trettel
(74) *Attorney, Agent, or Firm*—Robert L. Wolter; Beusse Brownlee Wolter Mora & Maire, P.A.

(57) ABSTRACT

An arm pillow comprising a pillow having an elastic support sleeve attached to a backside of the pillow. The support sleeve fits snugly over a user's elbow so the pillow will not move on the elbow.

2 Claims, 4 Drawing Sheets

ARM PILLOW FOR HOLDING A CHILD

BACKGROUND OF THE INVENTION

This invention relates in general to infant care devices. More specifically, the invention pertains to arm pillows used to support an infant's head while being held.

When an infant is held, often times the head is placed in the crook of the bent elbow on one arm to support the child's head. The other arm is used to support the child's back and legs. The person's arm supporting the child may become fatigued after holding the infant for an extended period, for example when the person feeds the child, or is trying to cradle the child to sleep. As a result the person holding the child may have to reposition the child's head on his/her arm, or otherwise adjusts the baby's position in his/her arms to maintain some comfort level for herself/himself and/or the baby.

Arm pillows are available that provide a cushion to support the child's head, and means attached to the pillow, for supporting the cushion on a person's arm. However, many of the designs are too bulky either for the child's head to be placed in a comfortable position, or for smaller persons using the pillows. In addition, many of such products fit too loosely on one's arm and tend to slip on the arm.

SUMMARY OF THE INVENTION

The present invention for an arm pillow comprises a pillow having a front side and a backside. An elastic support sleeve is attached to the backside of the pillow through which a users arm may extend and supports the cushion on the user's arm. The elastic sleeve is placed on a user's arm and is disposed over the elbow. The elastic nature of the sleeve provides a sufficient grip on the arm to prevent the pillow from shifting or rotating on the arm.

DETAILED DESCRIPTION OF THE DRAWINGS

Figure 1:
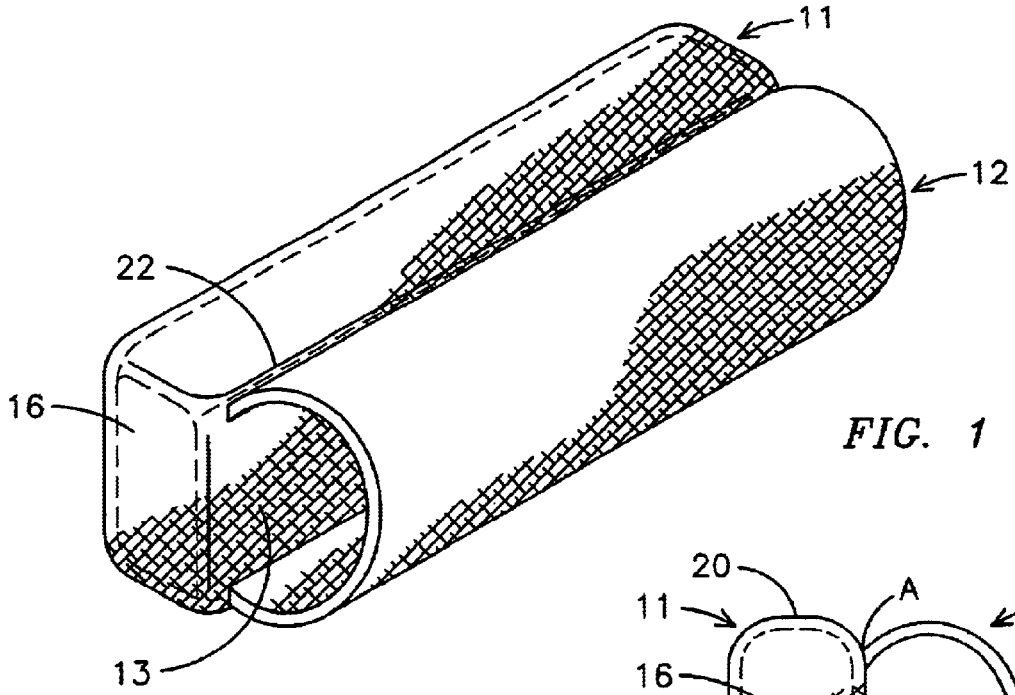
FIG. 1 is a perspective view of the arm pillow.

An embodiment of the present invention for an arm pillow 10 is illustrated in FIG. 1. The arm pillow 10 comprises a pillow 11, with an elastic support sleeve 12 attached to the pillow 11. In the embodiment described herein, the pillow 11 includes a cushion 16 encased within a soft fabric casing 20, which has at least one seam 22, dividing the pillow 11 into a front side 14 and backside 13.

The pillow 11 should be small enough so it is not cumbersome to place on and remove from an individual's arm. Nor should it be too thick to prop a baby's head and neck at an awkward angle. For example, a pillow 11 and casing having a length of about 12 inches, a width of 4 inches and thickness of about 3–6 inches is desirable. The casing 20 should be constructed of a soft fabric, such as cotton, that has a texture that will not irritate the baby's skin. The cushion 16 may be constructed of soft, compressible foam material, or other synthetic or natural material, such as down typically used to make a pillow.

Figure 2:
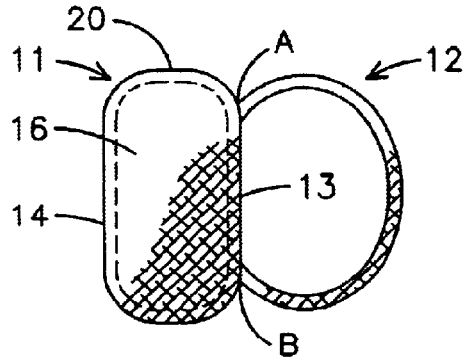
FIG. 2 is an end elevational view of the arm pillow.
Figure 3:
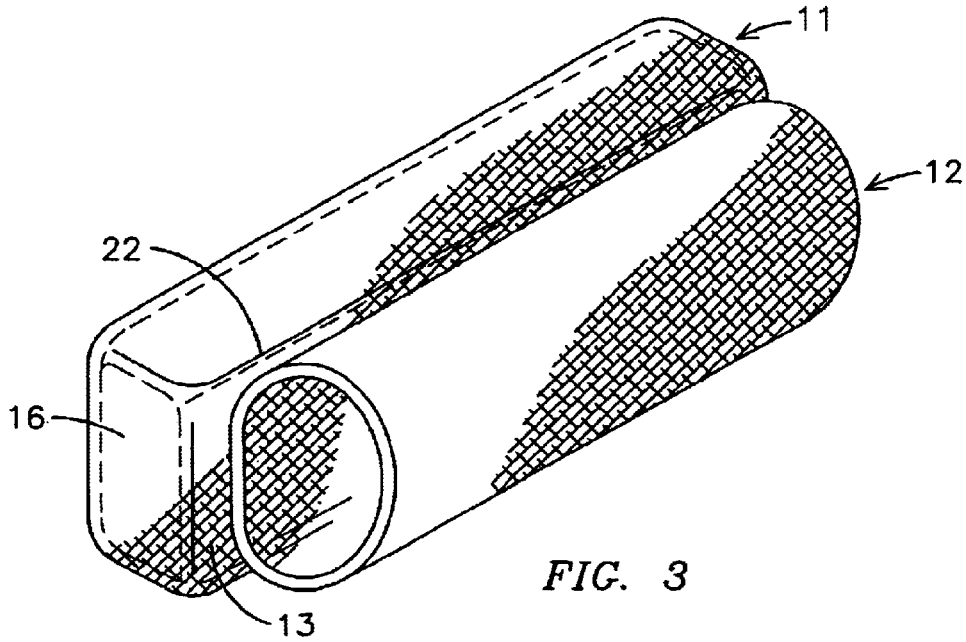
FIG. 3 is a perspective view of a second embodiment of the arm pillow with an unfolded sheet.

The elastic support sleeve 12 is constructed of a resilient and elastic material similar to that used to make Ace® bandages. The sleeve 12 may be sewn on the backside 13 of the pillow 11. Alternatively, the attachment to the pillow 11 may be in a less permanent manner such as with Velcro® strips, snap mechanisms or buttons, for example. In this manner, the sleeve 12 can be removed for washing. As shown in FIGS. 1 and 2, the sleeve 12 is a sheet of material having its edges affixed to the backside of the pillow 11 along points A and B. In the embodiment shown in FIG. 3, the elastic material takes the form of a sleeve affixed to the backside 13 of the pillow 11. In a preferred embodiment, the sleeve 12 is attached to the pillow 11 or casing 22 along points A and B, which are spaced apart at distances substantially equal to the width of the pillow 11 or casing 22.

Figure 4:
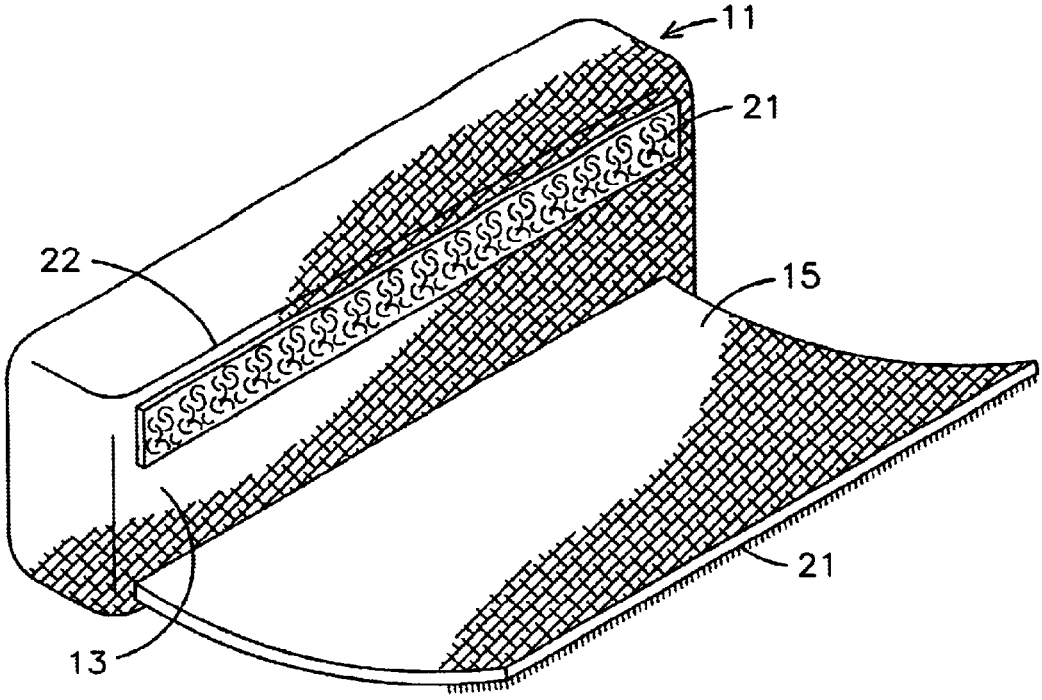
FIG. 4 is a perspective view of the third embodiment with the sheet material open.
Figure 5:
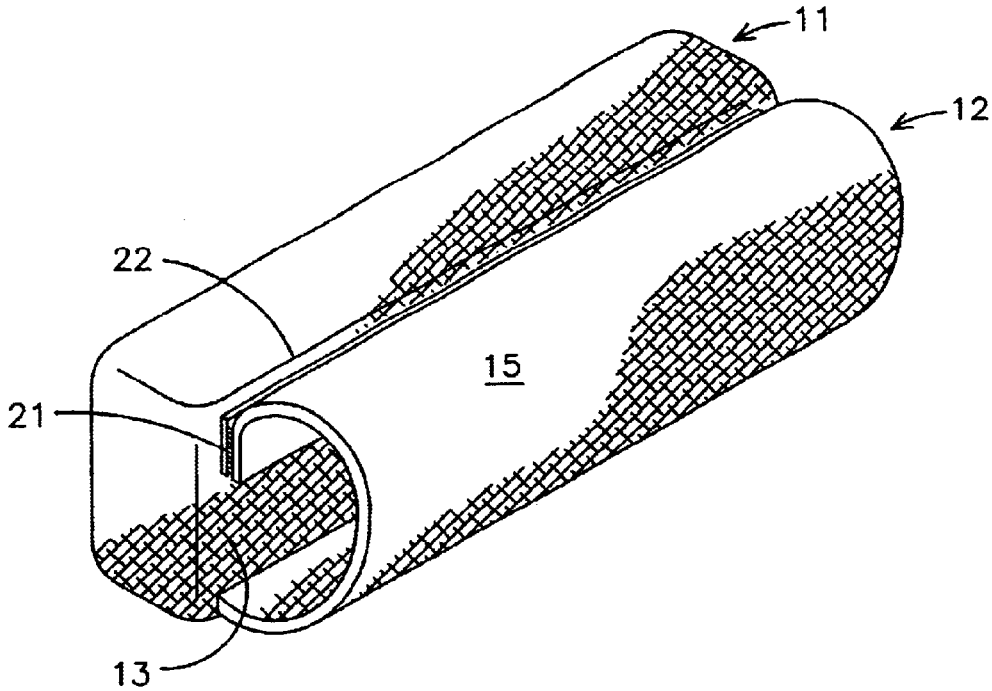
FIG. 5 is a rear perspective view of the third embodiment with the sheet material closed.
Figure 6:
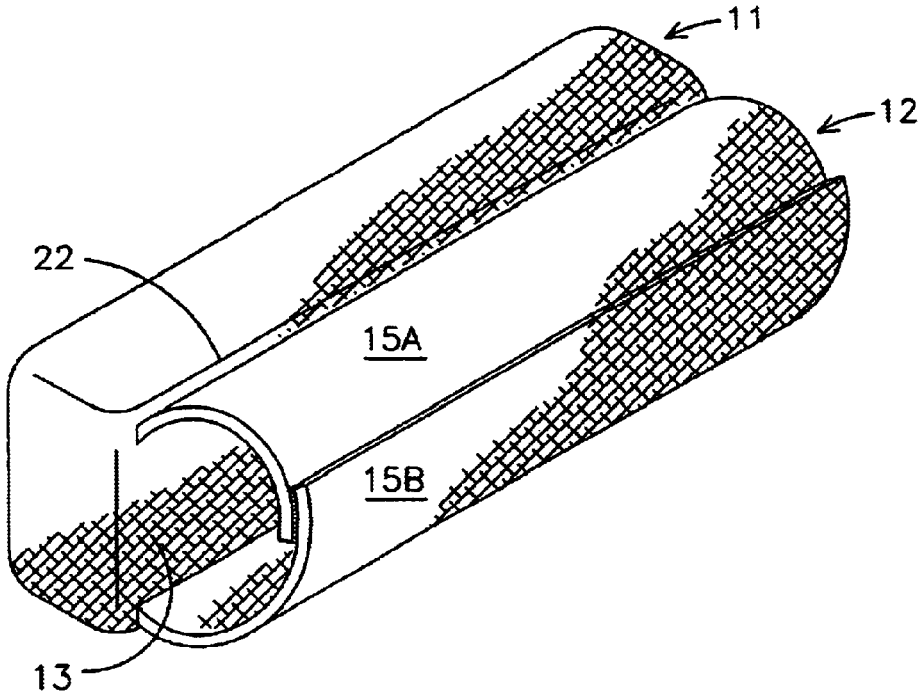
FIG. 6 is a perspective view of a fourth embodiment of the invention.

In another embodiment, the support sleeve 12 may take the form of a sheet that may be folded as shown in FIGS. 4 and 5 to form the sleeve 12. The sheet 15 includes securing mechanisms, such a Velcro® strips, snap mechanisms or buttons along its edges to secure the sheet 15 in the sleeve formation. Alternatively, two sheets 15A and 15B of elastic material may be affixed to the backside of the pillow 11, as shown in FIG. 6. The two sheets 15A and 15B are operatively and detachably connected to form the sleeve 12.

Figure 7:
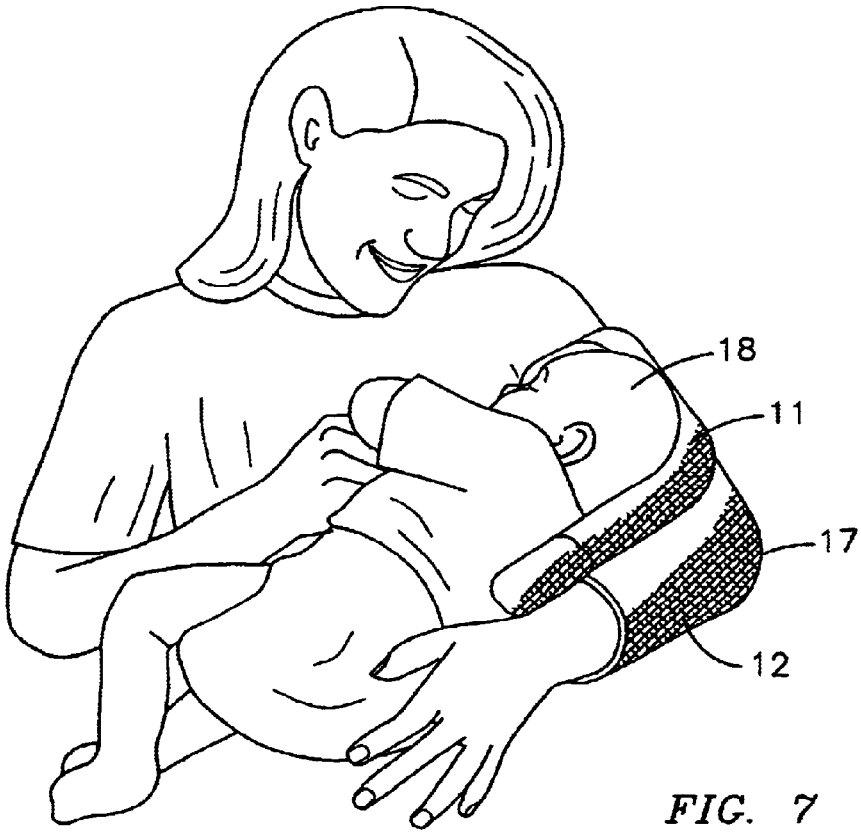
FIG. 7 is a perspective view of the arm pillow on a person holding a baby.

In use, an individual slips his/her arm through the support sleeve 12 over his/her arm so the support sleeve covers at least a portion of the individual's elbow 17, as shown in FIG. 7. The attachment of the support sleeve 12 at points A and B, along with the elastic nature of the support sleeve 12, grips the arm to prevent the cushion 11 from shifting on the individual's arm and under the head and neck of the baby 18.

Figure 8:
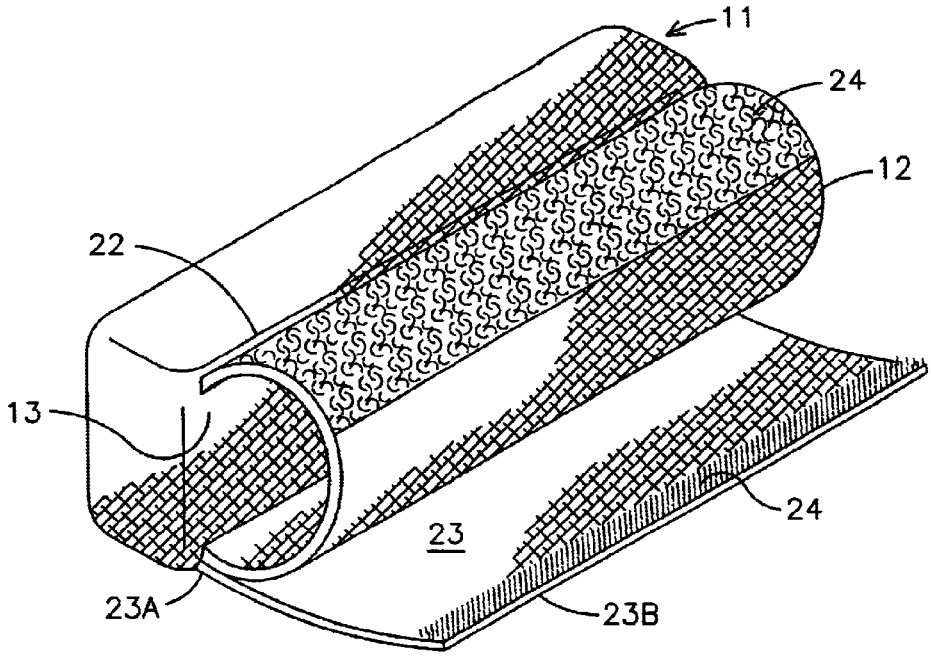
FIG. 8 is a perspective view of a fifth embodiment of the invention.

In yet another embodiment shown in FIG. 8, the arm pillow 10 has a strap 23 for tightening the support sleeve 12 on a user's arm. A strap 23 has a first end 23A attached to the sleeve 12 and a second end 23*b* that is removably attached to the sleeve 12. A fastening mechanism 24, such as Velcro® or buttons are disposed along the strap 23 and sleeve 12. The first end 23A of the strap is pulled upward over the sleeve 12 and attached to the fastening mechanism 24. The strap 23 preferably has a width that is substantially equal to the length of the sleeve 12.

While the preferred embodiments of the present invention have been shown and described herein, it will be obvious that such embodiments are provided by way of example only and not of limitation. Numerous variations, changes and substitutions will occur to those of skilled in the art without departing from the teaching of the present invention. Accordingly, it is intended that the invention be interpreted within the full spirit and scope of the appended claims.

I claim as my invention:

1. An arm pillow, comprising:

(a) a pillow having a front side and a backside;

(b) an elastic support sleeve, attached to the backside of the cushion, through which a user's arm may extend and supporting the cushion on the user's arm; and (c) a strap having a first end attached to the support sleeve and a second end that is removably attached to the sleeve.

2. A method of supporting an infant's head and such while holding the infant, comprising the steps of:

(a) providing a pillow having a front side and a backside;

(b) securing an elastic support sleeve to the backside of the pillow; and (c) positioning the sleeve on a user's arm covering the user's elbow.

* * * * *